US008919767B2

(12) United States Patent
Boos

(10) Patent No.: US 8,919,767 B2
(45) Date of Patent: Dec. 30, 2014

(54) BUNDLE OF PRINTED PRODUCTS AND METHOD FOR PRODUCING SAME

(75) Inventor: Konrad Boos, Stettfurt (CH)

(73) Assignee: Mueller Martini Holding AG, Hergiswil (CH)

( * ) Notice: Subject to any disclaimer, the term of this patent is extended or adjusted under 35 U.S.C. 154(b) by 208 days.

(21) Appl. No.: 13/462,473

(22) Filed: May 2, 2012

(65) Prior Publication Data

US 2012/0280482 A1 Nov. 8, 2012

(30) Foreign Application Priority Data

May 3, 2011 (CH) ..... 0754/11

(51) Int. Cl.
*B65H 31/06* (2006.01)
*B65H 33/08* (2006.01)

(52) U.S. Cl.
CPC ..... *B65H 31/06* (2013.01); *B65H 33/08* (2013.01); *B65H 2301/4219* (2013.01); *B65H 2301/45* (2013.01); *B65H 2301/42146* (2013.01)
USPC ..... 271/181; 270/58.11; 270/58.12; 270/58.17; 270/58.27; 53/529; 53/542

(58) Field of Classification Search
CPC ..... B65B 35/56; B65B 61/24; B65B 61/26; B65H 29/00; B65H 2301/4317; B65H 2301/43; B65H 2301/42146; B65H 2301/42192; B65H 2301/4219; B65H 2301/3621
USPC ..... 270/52.16, 58.11, 58.12, 58.17, 58.27, 270/58.29; 271/181, 184; 53/445, 542, 529
See application file for complete search history.

(56) References Cited

U.S. PATENT DOCUMENTS

| | | | |
|---|---|---|---|
| 3,518,940 | A | 6/1967 | Stroud et al. |
| 3,690,474 | A | 9/1972 | Klappenecker |
| 3,994,487 | A | 11/1976 | Wicklund |
| 4,509,739 | A | 4/1985 | Kurokawa |

(Continued)

FOREIGN PATENT DOCUMENTS

| | | |
|---|---|---|
| EP | 0570251 | 4/1993 |
| EP | 1950159 | 12/2007 |

(Continued)

OTHER PUBLICATIONS

International Search Report of CH 7542011 Dated Aug. 12, 2011 With an English Translation.

(Continued)

*Primary Examiner* — Leslie A Nicholson, III
(74) *Attorney, Agent, or Firm* — Venable LLP; Robert Kinberg, Esq.; F. Brock Riggs, Esq.

(57) ABSTRACT

A method for producing a bundle composed of book blocks includes gathering a plurality of printed sheets to form respective book blocks. The plurality of the book blocks are positioned with the same orientation and respectively positioned on lower edges of the printed sheets. Respectively two adjacent book blocks are offset from one another parallel to the lower edges of the printed sheets and transverse to a height of the bundle to be formed, such that a side edge of one of the two book block projects relative to a side edge of the adjacent book block. Thereafter the offset book blocks are combined to form the bundle and the bundle is compressed to fix the offset position of the book blocks.

10 Claims, 3 Drawing Sheets

(56) References Cited

U.S. PATENT DOCUMENTS

| | | | | |
|---|---|---|---|---|
| 4,655,131 | A | 4/1987 | Kramer | |
| 4,940,219 | A | 7/1990 | Volat | |
| 5,218,813 | A * | 6/1993 | Seidel | 53/399 |
| 5,450,940 | A * | 9/1995 | Rathert et al. | 198/412 |
| 5,485,989 | A * | 1/1996 | McCay et al. | 271/2 |
| 5,515,667 | A * | 5/1996 | Roosli | 53/542 |
| 6,161,830 | A | 12/2000 | Yap | |
| 6,453,645 | B1 | 9/2002 | Suokas et al. | |
| 6,682,067 | B1 | 1/2004 | Keane et al. | |
| 6,782,678 | B1 * | 8/2004 | Bodereau | 53/542 |
| 7,021,035 | B2 * | 4/2006 | Muri et al. | 53/542 |
| 2006/0290046 | A1 | 12/2006 | Sanmiya et al. | |

FOREIGN PATENT DOCUMENTS

| | | |
|---|---|---|
| EP | 2098465 | 3/2008 |
| EP | 2159070 | 8/2008 |
| EP | 2 070 854 A2 | 6/2009 |

OTHER PUBLICATIONS

International Search Report in Application No. CH 10612011, dated Oct. 7, 2011.

Notice of Allowance in U.S. Appl. No. 13/530,895, dated Feb. 20, 2014.

* cited by examiner

BUNDLE OF PRINTED PRODUCTS AND METHOD FOR PRODUCING SAME

CROSS-REFERENCE TO RELATED APPLICATION

This application claims the priority of Swiss Patent Application No. 00754/11, filed on May 3, 2011, the subject matter of which is incorporated herein by reference.

BACKGROUND OF THE INVENTION

The present invention relates to a bundle and a method for producing this bundle for which a plurality of printed sheets are gathered to form a book block and a plurality of book blocks, oriented in the same way and respectively positioned standing upright on the lower edges of the printed sheets, are then combined to form a bundle and are compressed. For this, two adjacent book blocks are positioned offset, relative to each other, prior to the compressing operation and are then fixed in position following the compressing operation. Bundles of this type are produced for intermediate storage of printed sheets with the aid of so-called bundle delivery machines. In the process, printed sheets which are positioned upright and lined up in a row are gathered to form a bundle, are subsequently compressed and then strapped together.

As is known, for the production of perfect-bound printed products such as hardcover books, paperback books and similar products, the required number of printed sheets and the covers are normally printed in an optional sequence during a first step and are then stored temporarily. For this, the printed sheets which can be folded individual sheets or signatures with glued-on fly leaf are gathered in the correct sequence to form loose book blocks, are combined with additional book components such as cases for hardcover products, fly leaves, combination fly leaves, or covers and are then supplied to a perfect binder where they are bound along the spine and are glued together with the cover or the slip-fold strip. By separating the printing process from the binding process, both processes can be realized with the optimum speed. However, it has turned out to be a disadvantage that the binding process can be carried out only after all printed sheets and covers have been printed, which requires a relatively large stock of printed sheets and covers.

Printing presses are also known which sequentially print all pages of a book and subsequently deliver complete, loose book blocks that can be supplied directly to a perfect binder. A printing press of this type is known from the U.S. Pat. No. 3,518,940. With this method, which is used rarely in practical operations, the intermediate storage of printed sheets can be avoided but it also requires an extremely involved printing press. In addition, this method only makes economic sense when it is used for extremely large editions and the achievable print quality is furthermore low.

Digital printing presses have been known for some time which sequentially print all pages of a book and then supply complete, loose book blocks that can be bound without requiring further operations. Accordingly, a digital printing press can be used to optionally produce one after another complete book blocks with differing contents. A further advantage of the digital printing press is that no printing plates are required. In addition to avoiding the costs of producing the printing plates, the operational interruptions necessary for replacing the printing plates are also omitted. The printed sheets or individual pages that form a book block are delivered in the form of a stack, for example deposited offset to each other on a pallet, such that they can be separated again easily later on. Alternatively, full-surface layers of book blocks can also be formed, wherein the layers are separated by an intermediate layer. Book blocks stacked in this way can be stored for an optional length of time before being supplied to a perfect binder.

The depositing of loose stacks on pallets can be effected manually or automatically with a so-called palletizer. A device of this type is disclosed in the European Patent document EP 2098465 A1. The loose sheet stacks of horizontally positioned printed products are removed again manually from the pallet at a later date and are supplied to the feeding region of a perfect binder. However, this solution has the known disadvantage that the loose book blocks are not sufficiently compressed along the fold region, thereby resulting in products which are considerably thicker in the fold region than in the flat region. In addition, the lower book blocks are compressed most and the top ones are not compressed at all. Poorly compressed book blocks or book blocks compressed with different strength can lead to serious problems during further processing or can hinder further processing.

European Patent document EP 2159070 A1, discloses that printed sheets in a stack are glued together along one edge region. As a result, the stacks can be separated again clearly at a later point in time, prior to the further processing. With this method, the printed sheets are also compressed irregularly or insufficiently, which results in the aforementioned disadvantages. The glued together printed sheets furthermore can no longer be aligned in the perfect binder. The surface area of the printed sheets, which is necessary for the gluing and must be cut off in the three-blade cutter during the final trimming step, represents a further disadvantage by considerably increasing the amount of paper used. An additional disadvantage results from the thickening of the stack at those locations where adhesive is applied to the printed sheets, thereby making the further processing more difficult.

Also known is a method of gluing the printed sheets together along the fronts rather than between the flat sides. In addition to the above-mentioned disadvantages of such gluing operations, this method has the further disadvantage that glue can be deposited on the paper guides during the further processing, thereby causing machine malfunctions and requiring cleaning expenditure.

Instead of depositing the stacks of printed sheets on pallets or similar devices, methods are also known for which the printing press is arranged and operated in line with the perfect binder. Since the printing press can print continuously, as previously mentioned, a buffer or storage section must be provided between the printing press and the further processing locations, wherein the buffer capacity must be sufficient to individually store the book blocks which are printed during a period of changeover to the further processing operations. Additional buffer capacity should also be provided in case the further processing operations stop for any reason. Alternatively, the book blocks printed during such an interval can also be transferred out and can be supplied once more later on.

European Patent document EP 1950159 A1 discloses a stack-type arrangement of flat printed products, wherein all printed products within the stack have the same orientation. One of the four sides of the printed products is thicker than the other sides, for example because the printed products have a fold or even a staple on this side. To ensure that these stacks have the same stability as the stacks composed of partial stacks which are offset relative to each other by 180°, the partial stacks in this case are offset transverse to the thicker side and alternating. In the process, the partial stacks are offset perpendicular to the lower edges in the direction of the stack height. Stacks configured in this way have the disadvantage that the printed products within the stack are compressed differently strong in the region of the thicker side, thereby causing the non-compressed fold regions to have a tendency to fan out.

SUMMARY OF THE INVENTION

It is an object of the present invention to provide a method for intermediate storage of loose book blocks, composed of gathered printed sheets, which allows these book blocks to be separated again clearly after the intermediate storage. It is furthermore an object of the invention that the book blocks are compressed with a defined force during the intermediate storage.

The above and other objects are accomplished according to the invention, wherein according to one embodiment there is provided a method for producing a bundle composed of book blocks, comprising: gathering a plurality of printed sheets to form respective book blocks; positioning a plurality of the book blocks with the same orientation and respectively positioned on lower edges of the printed sheets; offsetting respectively two adjacent book blocks parallel to the lower edges of the printed sheets and transverse to a height of the bundle to be formed, such that a side edge of one of the two book block projects relative to a side edge of the adjacent book block; thereafter combining the offset book blocks to form the bundle; and compressing the bundle to fix the offset position of the book blocks.

Owing to the offset to the side from book block to book block within the bundle when using this method, unambiguous locations of separation are formed which make it possible to separate the loose book blocks later on. Positioning book blocks in this way in the form of a bundle is the only way to ensure that all book blocks and printed sheets are compressed with the same force and that no deformation of individual book blocks can occur prior to the removal of the book blocks at a later point in time, for example shortly before the further processing.

The book blocks may be gathered in a manner in which the bundles are formed such that the folded edges of the printed sheets can be used as the lower edges. With folded printed sheets, the folded edge may be created last during the course of the folding operation and this "last folded edge" is used as the lower edge since its mechanical load capacity is highest.

According to one embodiment of the method, n book blocks can be formed with at least a first and a last book block section having the same format, and the book block sections on both sides of the bundle to be formed can respectively be provided with one side edge. For this, the side edge of the last book block section of a book block is respectively offset relative to the side edge of the first book block section of an adjacent book block, meaning on a first or a second side of the bundle to be formed or alternating between both sides. In this manner, an offset is easily created which is advantageous, for example, for a uniform separation of the book blocks.

According to another embodiment, the book blocks in the bundle can respectively be composed of printed sheets having a different print content. For example, the printed sheets can arrive from a digital printer which can produce optionally and one after another complete book blocks with differing contents.

The above-described method can be used to produce a bundle, comprising: a plurality of book blocks for which a plurality of gathered printed sheets form a respective one of the book blocks, wherein the book blocks are combined with the same orientation and respectively positioned standing on lower edges of the printed sheets and are compressed, wherein respectively two adjacent book blocks are offset relative to each other and are fixed in the offset position, and wherein each book block is offset parallel to the lower edges of the printed sheets and transverse to a height of the bundle such that a side edge of one book block projects relative to a side edge of an adjacent book block.

According an embodiment, folded edges of the printed sheets in the bundle advantageously form the lower edges.

In another embodiment, the book blocks contained in the bundle are formed with at least one first and one last book block section having the same format, wherein each book block section is provided with a side edge. For this, the side edge of the last section of a book block is respectively offset to the side, relative to the side edge of the first book block section of an adjacent book block, meaning on a first or a second side of the bundle or alternating between both sides.

For the case where the book blocks in the bundle are respectively composed of printed sheets, for example sheets arriving from a digital printing press, and are imprinted with differing print contents, each book block in the bundle can have a different print content.

In another embodiment, the bundle can also comprise other parts of a book in addition to the printed sheets gathered into book blocks, for example book cases used for hardcover books, or fly leaves, or combination fly leaves, or covers.

According to yet another embodiment, the printed sheets and/or the book blocks and/or the bundles may be provided with at least one information carrier for the purpose of identification. During further processing operations, a separate processing can consequently be assigned either to each individual bundle or to the components in the bundle.

BRIEF DESCRIPTION OF THE DRAWINGS

These and other features and advantages of the invention will be further understood from the following detailed description with reference to the accompanying drawings.

DETAILED DESCRIPTION

Figure 1:
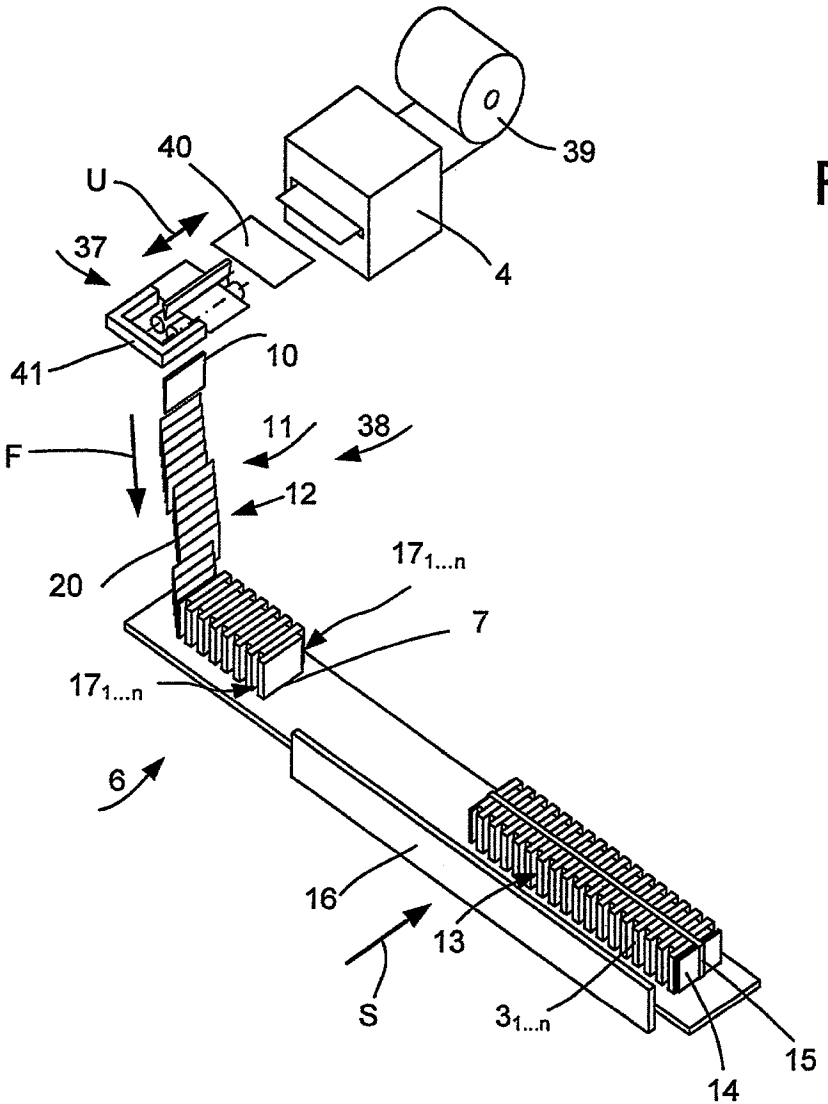
FIG. 1 is a schematic representation of a method according to the invention for producing a bundle.
Figure 1A:
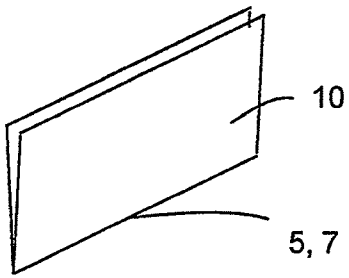
FIG. 1*a* shows a single printed sheet.

FIG. 1 shows an exemplary embodiment of a bundle former 6 with an upstream arranged printing press 4. The printing press 4, e.g. a digital printing press, prints on a paper web that is unwound from a paper roll 39 and is cut into sections 40 following the printing operation. These sections 40, also called printed sheets, can be delivered either as printed sheets 10 folded in a folding device 37 or as unfolded sheets in the form of an overlapping stream 11. The printed sheets 10 have a lower edge 7 which can be a folded edge 5 as shown in FIG. 1*a*. The book blocks $\mathbf{3}_{1 \ldots n}$ formed with these sheets have two side edges $\mathbf{17}_{1 \ldots n}$.

FIG. 1 shows the folding device 37 embodied as a sword-type folding mechanism which conveys the book sections 40 with the aid of a sword between two folding rollers where they are subsequently folded. The end of the conveying path for the sections 40 in front of the folding device 37 can be selected with the aid of an end stop 41 that is adjustable in direction U. Through a cyclical adjustment of the end stop 41, partial overlapping flows 12 can be formed which are offset in a direction transverse to the conveying direction F. If the end stop 41 is adjusted alternating after each last section 40 of a book block $\mathbf{3}_{1 \ldots n}$, partial overlapping flows 12 are formed transverse to the conveying direction F, which are alternately offset to the left and the right in conveying direction F, corresponding to the content of a book block 3, and are conveyed further in conveying direction F with the aid of an overlapping flow conveyor 38. Instead of being folded, the sections 40 can also be conveyed directly in transverse direction, starting with the end stop, so as to form an overlapping flow 11. As a further alternative, stacks can be formed with these sections 40, wherein these sections are subsequently transferred to an overlapping flow 11. In addition to the printed sheets 10 which are gathered to form book blocks $\mathbf{3}_{1 \ldots n}$, the bundle can also contain other book parts 20, in particular book cases for hardcover products, fly leaves, combination fly leaves or covers.

The overlapping flow 11 is formed into a bundle 13 with height H (FIG. 2*b*) inside the bundle former 6 and is provided with end boards 14, is then compressed with an adjustable force and is strapped together with the aid of a traction element 15. As a result of the offset of the partial overlapping flows 12, relative to each other, the book blocks $\mathbf{3}_{1 \ldots n}$ in the bundle 13 are also stacked offset to each other. The compressing force is maintained in the strapped bundles 13, meaning all printed sheets 10 within the bundles 13 remain compressed with the same force. As a result of the compressing, the spring-back of the book blocks $\mathbf{3}_{1 \ldots n}$ is reduced considerably in the region of the folds when the traction element 15 is released, thus making it possible to achieve a higher product quality during the further processing of the book blocks $\mathbf{3}_{1 \ldots n}$ since no deformation of the book blocks $\mathbf{3}_{1 \ldots n}$ can occur any longer. The bundle former 6 can be embodied, for example, in the same way as the generic device disclosed in the document EP623542 A1. A pusher 16 then pushes the strapped bundle 13 in pushing direction S, for example onto a buffer or storage device.

Different devices for compressing and stabilizing the bundles 13 can conceivably also be used in place of the end boards 14 and the traction elements 15. For example, the bundles 13 can be held together and compressed with the aid of reusable clamps, wherein the clamps could be returned automatically or manually to the bundle former 6 following the opening.

Figure 2B:
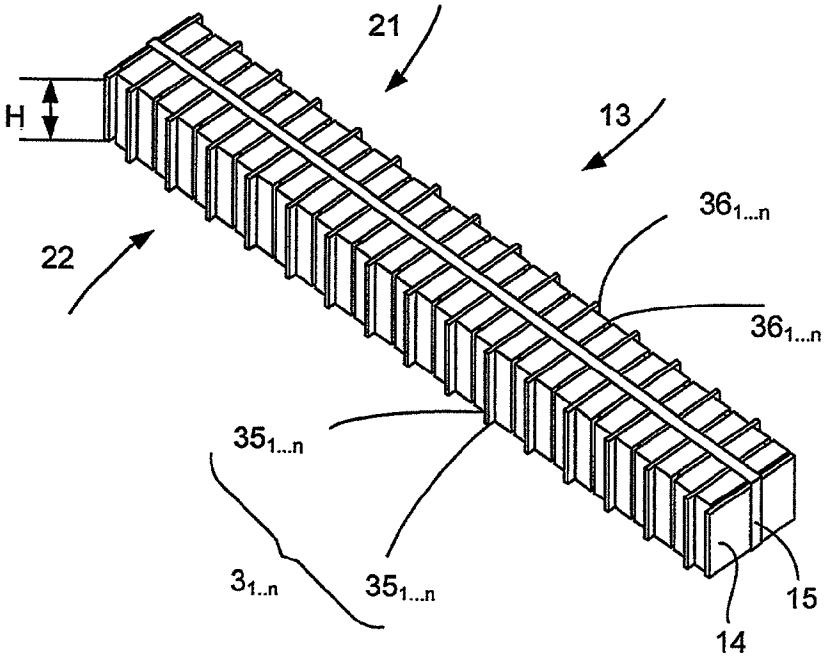
FIG. 2*b* shows a bundle formed with partial book blocks.
Figure 2A:
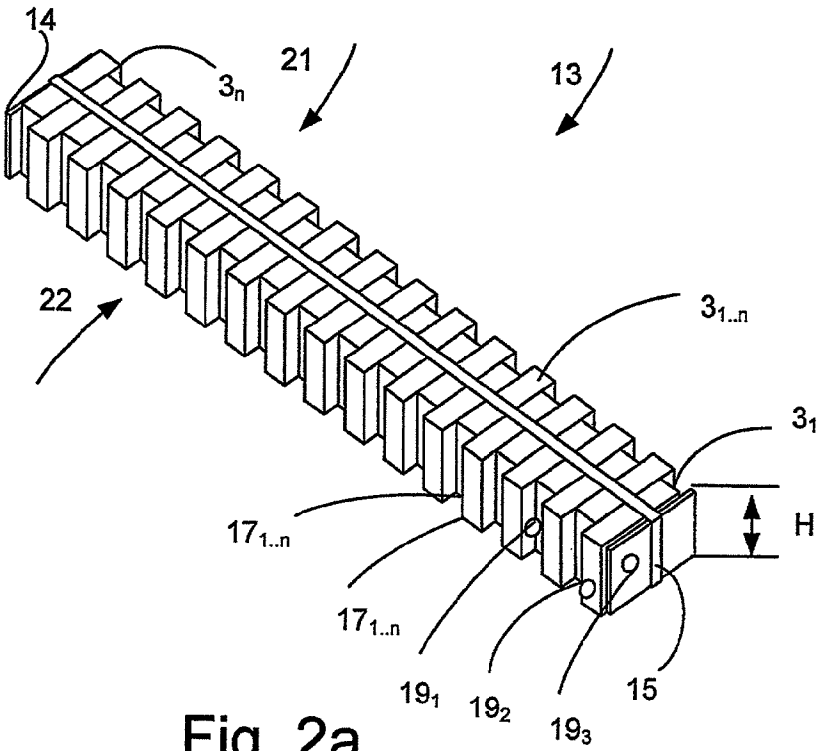
FIG. 2*a* shows a bundle formed with book blocks.

FIG. 2*a* shows the basic configuration of a bundle 13 composed of book blocks $\mathbf{3}_{1 \ldots n}$, for which several printed sheets 10 (FIG. 1) are gathered to form a single book block $\mathbf{3}_{1 \ldots n}$ and several book blocks $\mathbf{3}_{1 \ldots n}$ with the same orientation are compressed into a bundle 13, respectively while positioned on the lower edges 7 (FIG. 1) of the upright standing printed sheets 10. Respectively two adjacent book blocks $\mathbf{3}_{1 \ldots n}$ are offset relative to each other and are fixed in this position, wherein a book block $\mathbf{3}_{1 \ldots n}$ is offset parallel to the lower edges 7 of the printed sheets 10 (FIG. 1) and transverse to a height H of the bundle 13 in such a way that a side edge $\mathbf{17}_{1 \ldots n}$ of at least one book block $\mathbf{3}_{1 \ldots n}$ projects relative to a side edge $\mathbf{17}_{1 \ldots n}$ of an adjacent book block $\mathbf{3}_{1 \ldots n}$. Within the bundle 13, the information carriers $\mathbf{19}_1$, $\mathbf{19}_2$, and $\mathbf{19}_3$ are shown herein as examples which are used for identifying the printed sheets 10 and/or the book blocks $\mathbf{3}_{1 \ldots n}$ and/or the bundles 13, depending on the location where they are attached.

Figure 2C:
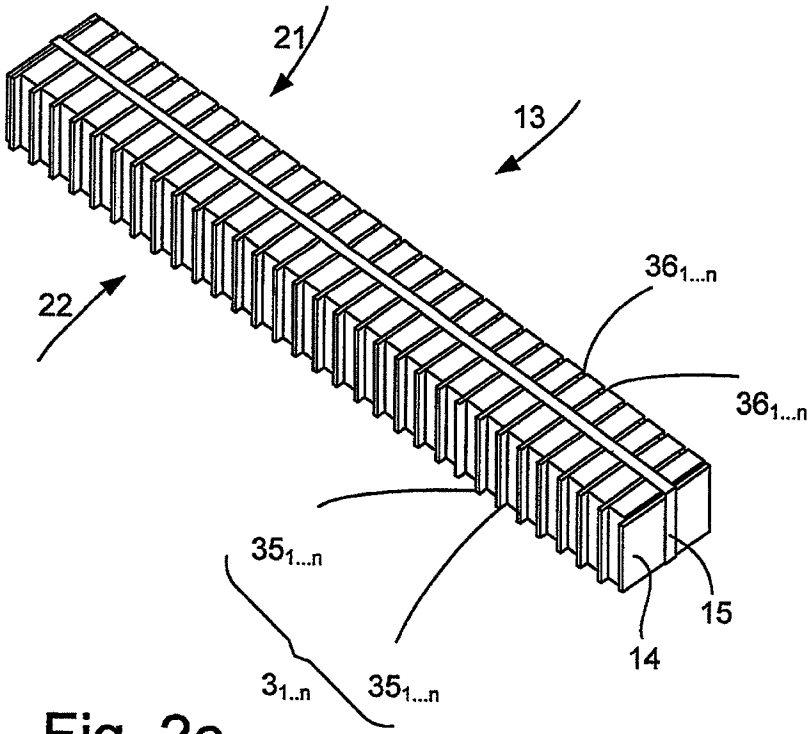
FIG. 2*c* shows a further variant of a bundle formed with partial book blocks.

Further exemplary embodiments of a bundle 13 are shown in FIGS. 2*b* and 2*c*. The book block $\mathbf{3}_{1 \ldots n}$ are composed of at least one first and one last book block section $\mathbf{35}_{1 \ldots n}$ of the same format and the book block sections $\mathbf{35}_{1 \ldots n}$ respectively have one side edge $\mathbf{36}_{1 \ldots n}$, wherein the side edge $\mathbf{36}_1$, of the last book block section $\mathbf{35}_{1 \ldots n}$ of a book block $\mathbf{3}_{1 \ldots n}$ is offset to the side, relative to the side edge $\mathbf{36}_{1 \ldots n}$ of the first book block section $\mathbf{35}_{1 \ldots n}$ of an adjacent book block $\mathbf{3}_{1 \ldots n}$, meaning on a first or second side 21, 22 of the bundle 13 (FIG. 2*b*) or alternating between both sides 21, 22 (FIG. 2*c*).

It will be understood that the above description of the present invention is susceptible to various modifications, changes and adaptations, and the same are intended to be comprehended within the meaning and range of equivalents of the appended claim.

What is claimed is:

1. A method for producing a bundle composed of book blocks, comprising:

gathering a plurality of printed sheets to form respective book blocks;

positioning a plurality of the book blocks with the same orientation and respectively positioned standing on lower edges of the printed sheets;

offsetting respectively two adjacent book blocks parallel to the lower edges of the printed sheets and transverse to a height of the bundle to be formed, such that a side edge of one of the two adjacent book blocks projects relative to a side edge of the other of the two adjacent book blocks;

thereafter combining the offset book blocks to form the bundle;

compressing the bundle to fix an offset position of the book blocks; and forming the bundle so that folded edges of the printed sheets are used for the lower edges.

2. The method according to claim 1, including forming the bundle so that respectively one last folding edge of the printed sheets is used as the lower edge.

3. A method for producing a bundle composed of book blocks, comprising:

gathering a plurality of printed sheets to form respective book blocks;

positioning a plurality of the book blocks with the same orientation and respectively positioned standing on lower edges of the printed sheets;

offsetting respectively two adjacent book blocks parallel to the lower edges of the printed sheets and transverse to a height of the bundle to be formed, such that a side edge of one of the two adjacent book blocks projects relative to a side edge of the other of the two adjacent book blocks;

thereafter combining the offset book blocks to form the bundle;

compressing the bundle to fix an offset position of the book blocks; and forming the book blocks with at least one first and one last book block section of the same format, wherein on both sides of the bundle to be formed the book block sections have respectively one side edge, and the offsetting includes offsetting the side edge of the last book block section of a book block to the side, relative to the side edge of the first book block section of an adjacent book block on one of a first or second side of the bundle or alternating between both sides of the bundle.

4. The method according to claim 1, including composing the respective book blocks in the bundle with printed sheets having differing print contents.

5. A bundle, comprising:

a plurality of book blocks for which a plurality of gathered printed sheets form a respective one of the book blocks, wherein the book blocks are combined with the same orientation and respectively positioned standing on lower edges of the printed sheets and are compressed, wherein respectively two adjacent book blocks are offset relative to each other and are fixed in an offset position, wherein each book block is offset parallel to the lower edges of the printed sheets and transverse to a height of the bundle such that a side edge of one book block projects relative to a side edge of an adjacent book block, and wherein the printed sheets have folding edges that form the lower edges for the bundle.

6. The bundle according to claim 5, wherein respectively one last folding edge of the printed sheets in the bundle forms the lower edge.

7. The bundle according to claim 5, wherein the respective book blocks in the bundle are composed of printed sheets with differing contents.

8. The bundle according to claim 5, wherein in addition to the printed sheets which are gathered to form the book blocks, the bundle also comprises other parts of a book including at least one a hardcover, fly leaves, combination fly leaves or covers.

9. The bundle according to claim 5, wherein at least one of the printed sheets, the book blocks and the bundle include at least one information carrier for identification.

10. A bundle, comprising:

a plurality of book blocks for which a plurality of gathered printed sheets form a respective one of the book blocks, wherein the book blocks are combined with the same orientation and respectively positioned standing on lower edges of the printed sheets and are compressed, wherein respectively two adjacent book blocks are offset relative to each other and are fixed in an offset position, wherein each book block is offset parallel to the lower edges of the printed sheets and transverse to a height of the bundle such that a side edge of one book block projects relative to a side edge of an adjacent book block, wherein the book blocks comprise at least one first and one last book block section of the same format and that the book block sections have respectively one side edge, and wherein the one side edge of the last book block section of a book block is offset relative to the one side edge of the first book block section of an adjacent book block on one of a first or second side of the bundle or alternating between both sides of the bundle.

* * * * *